United States Patent [19]

Meyer

[11] 4,408,724

[45] Oct. 11, 1983

[54] PULVERIZER DEVICE FOR HANDLING LIQUIDS CONTAINING SOLID AND SEMI-SOLID MATERIALS

[76] Inventor: Charles R. Meyer, Rte. 2, North Manchester, Ind. 46962

[21] Appl. No.: 357,253

[22] Filed: Mar. 11, 1982

Related U.S. Application Data

[63] Continuation-in-part of Ser. No. 255,337, Apr. 17, 1981, abandoned.

[51] Int. Cl.[3] ..... B02C 23/36

[52] U.S. Cl. ..... 241/46.17; 241/69; 415/121 B

[58] Field of Search ..... 241/46 R, 46.06, 46.11, 241/46.17, 69; 415/121 B

[56] References Cited

U.S. PATENT DOCUMENTS

| | | | |
|---|---|---|---|
| 3,323,650 | 6/1967 | Kilbane, Jr. | 241/46.17 X |
| 3,434,671 | 3/1969 | Cushing et al. | 415/121 B UX |
| 3,640,474 | 2/1972 | Niedl | 415/121 B X |
| 3,981,456 | 9/1976 | Hahn et al. | 241/46 R |
| 4,114,815 | 9/1978 | Gijsbers | 241/46.17 X |
| 4,182,499 | 1/1980 | Kemper | 241/46.17 X |

*Primary Examiner*—Howard N. Goldberg
*Attorney, Agent, or Firm*—Marmaduke A. Hobbs

[57] ABSTRACT

A pulverizer device for liquid handling systems which chops solid and semi-solid materials in the liquid to prevent plugging of and damage to pumps and other equipment in the system. The pulverizer device includes a housing having an inlet opening and a discharge opening and a screen disposed in the housing. A blade operates on the inlet side of the screen to chop material which initially will not pass through the screen. It is preferred that the blade be operated by a hydraulic motor, and that the housing have a sump with a clean-out on the side of the housing near the blade and screen for removing unpulverizable materials from the housing.

15 Claims, 6 Drawing Figures

Fig. 5
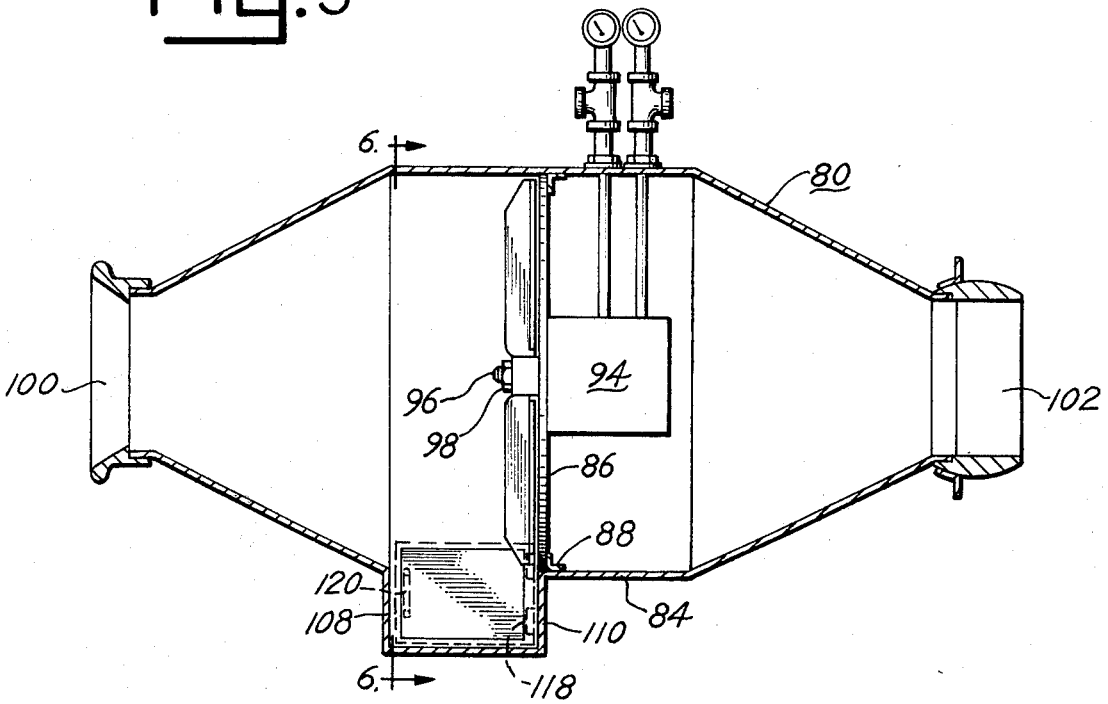
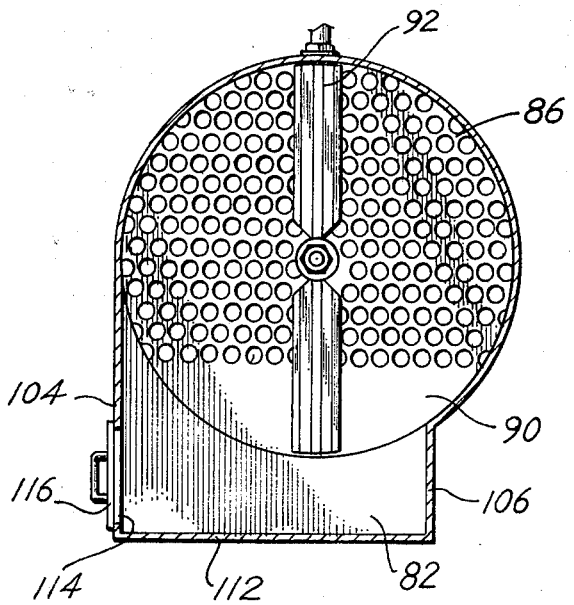
Fig. 6

PULVERIZER DEVICE FOR HANDLING LIQUIDS CONTAINING SOLID AND SEMI-SOLID MATERIALS

This application is a continuation-in-part of application Ser. No. 255,337 filed Apr. 17, 1981, now abandoned.

BACKGROUND OF THE INVENTION

Water in ponds, pits, lagoons and sumps from farm livestock buildings and operations, and in reservoirs, streams and the like, often contains solid materials and, when the water is pumped therefrom, the solid materials are sucked into the supply line. The solid materials, if not properly handled in the liquid, may either clog screens or pass into a pump or other equipment and interfere with the operation or cause serious damage to the equipment. The present invention is concerned with eliminating or minimizing the problem created by pumping liquids, primarily water, containing solid or semi-solid materials.

For the purpose of illustrating the present invention, reference will be made to the handling of liquid manure or the like, such as that usually encountered in raising livestock in confined areas. These liquid manure systems have become increasingly popular for handling animal wastes, particularly for large farming operations, in that greater mechanization and automation is possible with liquid manure systems than with other animal waste handling systems, thereby resulting in a savings in labor costs in handling the animal waste and creating greater productivity in the farming operation. Several types of liquid manure systems are commonly used. The animal waste may be stored in a pit beneath or near the building housing the animals, or the waste may be held in a lagoon for later disposal. Disposal of the liquid manure is generally accomplished by spraying the liquid onto a field and working it into the soil. The methods for transporting the liquid to the field may be of several types. One commonly used method is to pump the liquid from a pit into a vacuum tank, and then tow the tank through the field while spraying the liquid onto the field. Another method commonly used is to pipe the liquid manure from the lagoon or pit to the field, and to spray the liquid onto the field with spray guns similar to those used for water irrigation.

Problems are encountered frequently in liquid manure systems as a result of the presence of solid and semi-solid materials in the liquid manure. The liquid manure is more accurately called a slurry or sludge and often has solids from the animal waste as well as other foreign solid materials. For example, leaves, sticks and stones are often found in the liquid manure, especially when a lagoon is used to hold the liquid. Straw, wood chips or other bedding material, as well as hay and other animal food products are often found in the sludge or slurry making up the liquid manure. In liquid manure systems for fowl housing buildings, feathers from the birds and the carcasses of dead birds are often found in the manure slurry. Although much of a carcass will deteriorate rather quickly, the feathers and bones may remain.

When solids of any type are present in the liquid various handling difficulties arise. The solids can accumulate and obstruct the free flow of the liquid, thereby clogging pipes, hoses or other conduits used to pump the liquid containing solids from a pit, lagoon, stream or other body of water. Further, the solids or semi-solids can obstruct the nozzles in the spray guns or the spreader mechanism on the vacuum tank, thereby preventing the free flow of fluid therethrough. Still another problem encountered is that particularly large solids such as stones or sticks may damage the pumps used in transferring or transporting the liquid.

To prevent damage to the pumps of a liquid system, and to prevent clogging of spreader guns and nozzles, screens are used in the lines upstream from the vacuum pump. The screens prevent large debris, either solids or semi-solids, from entering and damaging the pump, and provide a more homogeneous liquid mixture or slurry flowing through the conduits. In a manure pit, for example, the screen will normally be disposed at or near the outlet from the pit. A problem which arises from the use of screens is that large solids such as sticks and stones or clumps of semi-solids may lodge in front of the screen and collect smaller material which otherwise would cause no problem in the manure handling system. The accumulation of large and small obstructions can block the flow of fluid through the screen, and the only suitable method for removing the blockage generally includes scraping the material from the front of the screen. Often, to do this, the worker may have to enter the pit to scrape the solids away. In piping systems which connect the lagoon or pit to a sprayer, a screen must be disposed at some location in the line upstream from the pump. Again, the solids can collect in front of the screen, and semi-solids which would otherwise not cause difficulty will fill the small areas between the larger solids and prevent the flow of liquid through the piping system. To clear the obstruction a portion of the piping system must be disassembled and the debris removed therefrom.

The cleaning methods for either of the above described systems require a substantial amount of time to perform and thereby decrease the efficiency of a liquid handling system. Further, once the obstruction has been cleared, the solids or semi-solids must be disposed of, this generally requiring some type of hand transporting and disposal. Many of the materials which cause blockage of liquid manure systems are found in a semi-solid state, and could be pulverized or chopped to pass through the liquid manure system. However, prior to this time no suitable device for pulverizing semi-solids in liquid handling systems has been available for general and convenient use.

SUMMARY OF THE INVENTION

It is therefore one of the principal objects of the present invention to provide a pulverizer device for liquid handling systems which can be attached to the intake line of a pump, vacuum tank or the like of the system to prevent solid and semi-solid materials from damaging the pump and spraying equipment, and which will pulverize much of the semi-solid and solid materials to permit the material to pass through the liquid handling system without damaging the system or blocking the flow of liquid.

Another object of the present invention is to provide a pulverizer for liquid handling systems which is self cleaning under normal circumstances so that many of the trapped objects will eventually pass through the system or can be removed from the pulverizer device, and which has a convenient access to the device for removing any objects which have accumulated therein.

Still another object of the present invention is to provide a pulverizer for liquid handling systems which can be used advantageously on pit or lagoon type systems, using either vacuum tank or spreader gun field application methods, and which can be added to existing systems without substantial modification to the existing systems.

These and other objects are achieved with the present invention by providing a housing having input and output ports therein adapted for attachment to a liquid handling system upstream from the pump of the system. A screen is disposed in the housing and has a blade or knife operating on the upstream side thereof to chop and pulverize materials which will not flow through the screen. Preferably, the blade is rotated by a hydraulic motor so that if nonpulverizable objects are encountered by the blade the increased hydraulic pressure from a tractor or the like operating the hydraulic motor will cause the hydraulic power to be curtailed. A further advantage of the hydraulic motor is that the direction thereof can be reversed to disengage the blade from materials which have become entangled thereon or which it partially enters but cannot cut. A trap or sump with a clean-out port is provided in the housing near the screen and blade so that nonpulverizable materials can be removed therefrom.

Further objects and advantages of the present invention will become apparent from the following detailed description and the accompanying drawings.

BRIEF DESCRIPTION OF THE DRAWINGS

FIG. 5 is a longitudinal cross sectional view of a pulverizer device disclosing a modified form of the present invention; and FIG. 6 is a transverse cross sectional view of the device shown in FIG. 5, the section being taken on line 6—6 of the latter figure.

DETAILED DESCRIPTION OF THE PREFERRED EMBODIMENT

Figure 1:
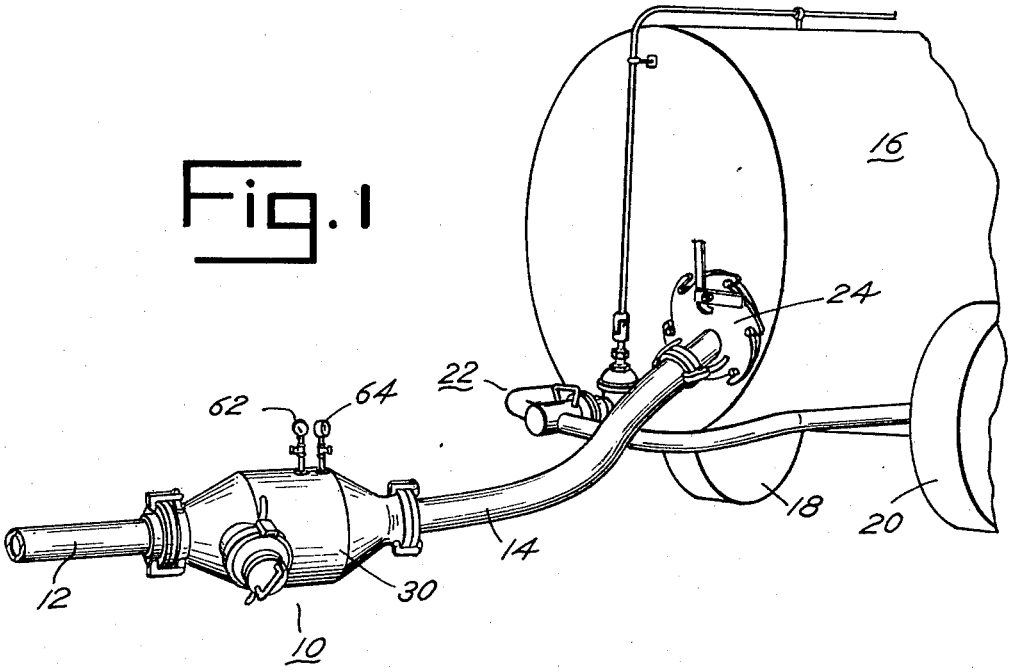
FIG. 1 is a perspective view of a pulverizer device for liquid handling systems embodying the present invention attached to, for example, a liquid manure system vacuum tank, shown partially broken away.
Figure 2:
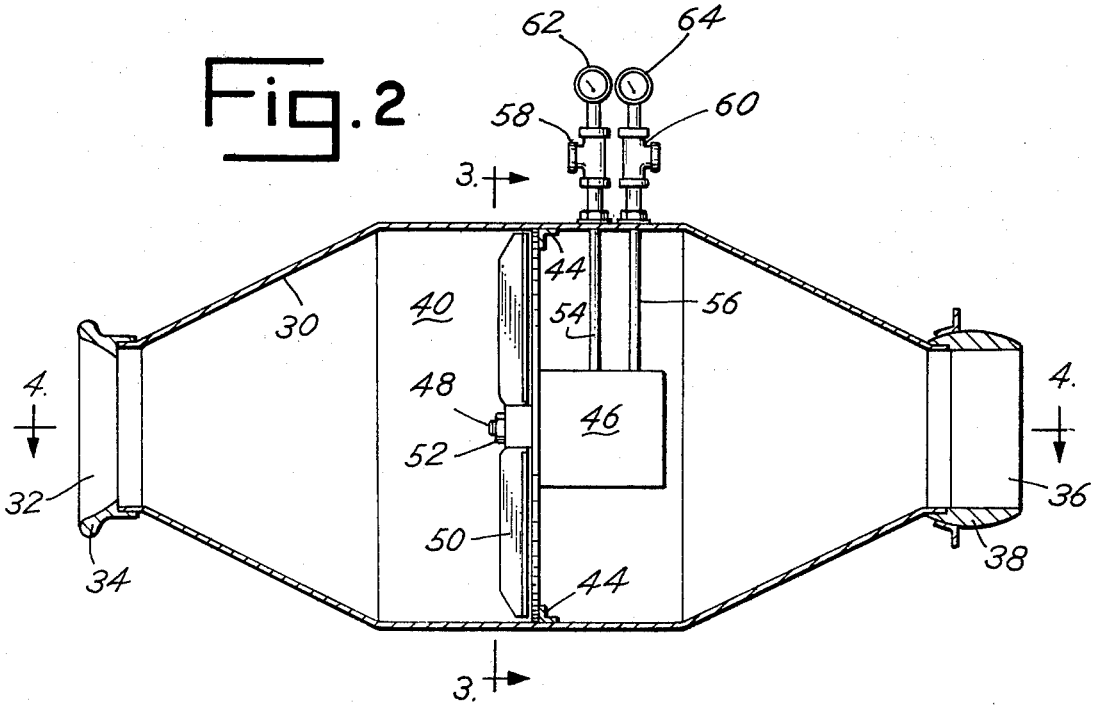
FIG. 2 is a cross sectional view of the pulverizer device shown in FIG. 1.
Figure 3:
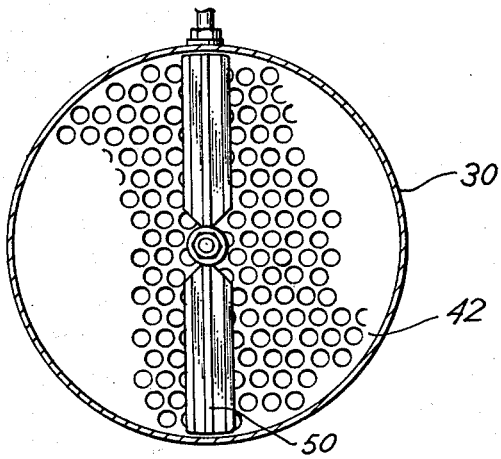
FIG. 3 is a cross sectional view of the pulverizer device shown in FIG. 2 taken on line 3—3 of the latter figure.
Figure 4:
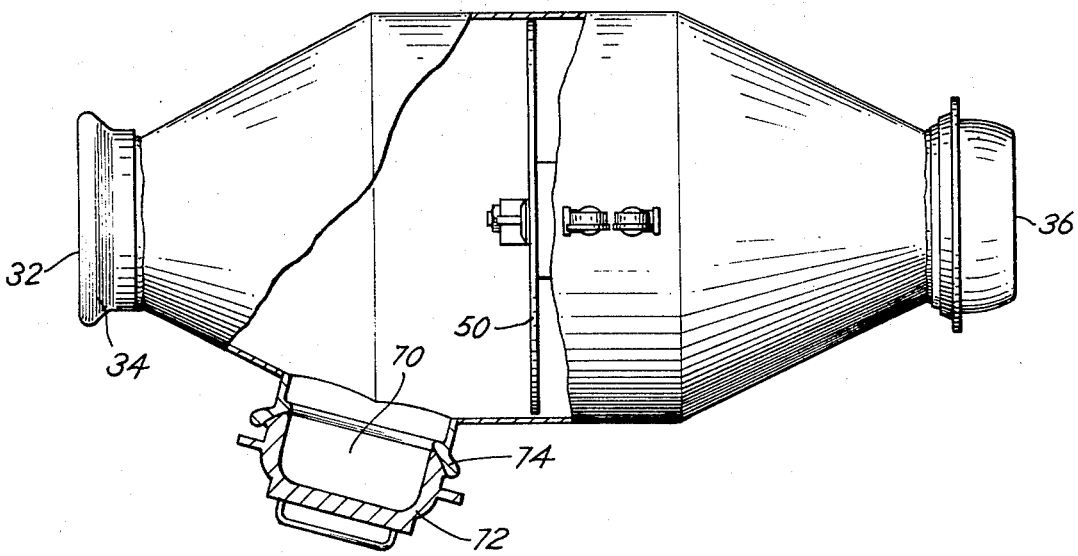
FIG. 4 is a plan view and partial sectional view of the pulverizer device of the present invention, the section indicated by line 4—4 of FIG. 2.

Referring now more specifically to the drawings, and to FIG. 1 in particular, numeral 10 designates a pulverizer device embodying the present invention which, for the purpose of illustration, is shown in conjunction with a liquid manure handling system and which is incorporated in the system between lines 12 and 14, which form conduits to bring liquid manure from a manure pit or lagoon to a vacuum spreader tank 16. The vacuum tank has wheels 18 and 20 permitting the tank to be towed through the field, and a spreader mechanism 22 for spraying the liquid manure onto the field. It should be understood that pulverizer device 10 may also be used in liquid systems having spray guns for discharging the liquid onto the field, and the vacuum tank shown is merely for illustrative purposes.

Pulverizer device 10 is connected to the hoses, pipes or other conduits used to bring the liquid manure from the holding means, such as a pit or lagoon, to the spreading and/or hauling means. The exact location of pulverizer 10 in the conduit is not critical; however, the pulverizer should be located upstream from the pump or any other mechanisms which could be damaged by large or hard materials in the liquid manure slurry. The pulverizer may be connected directly to the pump inlet or to an inlet cover 24 of vacuum tank 16, in which case a single hose from the pulverizer to the source of liquid manure may be used. When installed in this manner, the pulverizer can be left attached to the vacuum tank or pump, so that when manure is to be pumped from the holding means, the hose or other conduit can be attached directly to the pulverizer, just as it would be attached to the vacuum tank or pump if the pulverizer were not used.

Pulverizer 10 includes a housing 30 of metal or other durable material. An inlet opening 32 having a flange 34 for mating with the end of hose 12 is provided on one end of the pulverizer, and a discharge opening 36 having attachment mechanism 38 for connecting the pulverizer to a pump or vacuum tank is provided on the other end of housing 30. The structures on the ends of the housing may be of any suitable type for attaching the pulverizer in a liquid manure handling system. It is preferred that housing 30 have an enlarged area 40 between the inlet opening and discharge opening so that material flowing into the pulverizer from inlet opening 32 can disperse slightly for pulverization before being discharged through discharge opening 36. A screen 42 is disposed within housing 30 transverse to the flow of slurry through the housing, and is attached to a flange 44 on the inner surface of the housing by welding, or by other suitable attachment means. Screen 42 should be of a mesh size to permit the passage of only those solid objects of a size which would not damage the pump or cause other flow problems. Normally, a screen having one inch mesh openings is suitable for the pulverizer. All material flowing out of the pulverizer must pass through screen 42 between inlet opening 32 and discharge opening 36, and only particles small enough to pass through screen 42 are discharged from the pulverizer.

A hydraulic motor 46 is disposed in pulverizer 10 on the discharge side of screen 42 and has a drive shaft 48 extending perpendicularly through the screen at the center thereof to the inlet side of the screen. A blade 50 is disposed on shaft 48 and is held in place thereon by a nut 52. Only a minimal amount of clearance is provided between blade 50 and screen 42 so that objects which will not pass through the openings in screen 42 are immediately chopped by blade 50 to a size permitting the material to pass through the screen. A pressure line 54 and a return line 56 extend from motor 46 through housing 30. Hydraulic connectors 58 and 60 disposed on lines 54 and 56, respectively, permit attachment of the pulverizer to a hydraulic power source, such as a farm tractor or the like. Gauges 62 and 64 are provided for monitoring the pressure in the supply and return hydraulic lines.

In the use and operation of a pulverizer embodying the present invention, the pulverizer is attached to the inlet opening of a vacuum tank, spreader pump or the like at discharge opening 36. A supply line 12 is connected to inlet opening 32, and a source of hydraulic power, normally a farm tractor, is connected to hydraulic connectors 58 and 60 of supply line 54 and return line 56. When the liquid manure is being pumped through line 12 and pulverizer 10, the tractor or other source of hydraulic power is operated so that hydraulic motor 46 is in operation and blade 50 rotates in front of screen 42.

Material flowing into pulverizer 10 passes into area 40 and disperses slightly in front of screen 42. The liquid and small particles will flow through the screen and out discharge opening 36. Larger particles which cannot pass through screen 42 lodge against the screen and are held against the screen by the vacuum in the pulverizer. The large pieces are immediately chopped into smaller pieces by blade 50. The smaller pieces created from the chopping of large pieces can flow through the screen and out discharge opening 36 of pulverizer 10 and into a vacuum tank or spreader gun or the like. In this way, materials such as feathers, sticks, carcasses of fowl, and the like can pass through the liquid manure system without damaging or clogging the system.

Occasionally large, relatively hard objects which cannot be pulverized by blade 50 will be present in the liquid manure. These objects, such as, for example, a stone or a piece of hard wood, will lodge in front of screen 42. If blade 50 enters the object or strikes the object but cannot pass therethrough, motor 46 may stall, and the increased hydraulic pressure from the hydraulic fluid supply source of a farm tractor to the stalled hydraulic motor will return the hydraulic system of the tractor to neutral, thus preventing damage to the blade or hydraulic motor. If this happens, the operator can reverse the direction of fluid flow to the hydraulic motor. Line 56 is then a pressure line and line 54 a return line, and the direction of spin of blade 50 is reversed, to remove the blade from the object. If the blade cannot be freed in this manner, line 12 can be disconnected from pulverizer 10 and the object removed from area 40. To facilitate cleaning the pulverizer of objects which cannot be pulverized therein, a clean-out port 70 is provided having a cap 72 which locks in place thereon and can be removed therefrom. The clean-out port is located in the side wall of housing 30, near screen 42 on the intake side thereof, thus providing ready access to the area in front of the screen. Port 70 can be provided with a flange 74 similar to flange 34 of intake port 32, and ports 32 and 70 can be used interchangeably for connection to the liquid supply line 12.

Since the liquid manure flowing through the pulverizer is sucked through by means of vacuum from a pump or vacuum tank 16, the objects which will not flow through screen 42 are held against the screen for chopping by blade 50. The blade is located near screen 42 and only small portions are sliced from the objects. The small pieces can then be sucked through the screen. Power means other than a hydraulic motor may be used for driving blade 50. For example, a suitably sealed electric motor or other drive means may be used; however, the hydraulic motor is preferred, in that a person using such a system will normally have a farm tractor readily available to power the pulverizer, and the hydraulic motor will stall and cause the hydraulic power means to shift to neutral before damage can occur to the motor, blade or pulverizer housing if objects which cannot be pulverized are encountered. The reversible operation of the hydraulic motor is also advantageous in freeing the blade from objects which are not completely chopped through.

In FIGS. 5 and 6, a modified form of the present pulverizer device is illustrated, in which a housing 80, similar to housing 30, is installed between line sections 12 and 14 and contains a sump 82 which extends downwardly below the cylindrical portion 84 of the housing. This modification is an extension of the concept involving clean-out port 70, but is designed to permit a more effective and prolonged operation of the pulverizing device. The device shown in FIGS. 5 and 6 is particularly useful where the system may enounter a relatively large amount of solid materials incapable of being disintegrated by the blade to the extent required to permit the solid materials to pass through the holes of the screen 86 behind the blade. The screen is mounted in cylindrical portion 84 and is a perforated plate secured rigidly therein by an annular angle iron member 88 secured to the inside surface of cylindrical portion 84. The screen 86 is similar to screen 42, except that the bottom portion 90 thereof is preferably imperforate. The screen is rigid, flat and smooth on the intake side, and a rotatable blade 92 is driven by hydraulic motor 94 by a shaft 96 extending through the plate-like screen, and is secured to the shaft by a nut 98 threaded onto the shaft. The hydraulic system for operating motor 46 is capable of being used effectively for driving motor 94, and hence details of the hydraulic system will not be described with reference to the embodiment of FIGS. 5 and 6. The housing has an inlet opening 100 and a discharge opening 102 which are connected, respectively, to line sections 12 and 14. The sump 82 is formed by side walls 104 and 106 and end walls 108 and 110, all of which are joined at their edges to the adjacent walls and to a solid bottom 112. Wall 104 is provided with a clean-out opening 114 which is closed by a suitable door 116 or other type of closure, preferably supported by a hinge 118 and held in closed position by a spring partially shown at numeral 120. The size of the sump can be varied, depending upon the use for which the present disintegrator device is intended, and a clean-out mechanism may be provided for removing the solid particles or objects which accumulate in the sump during the operation of the pulverizer device. This mechanism may be a secondary vacuum system which removes the solid materials from the sump and discharges the unpulverized materials into a container or at a place apart from the liquid passing through screen 86.

In the modified form of the present invention illustrated in FIGS. 5 and 6, the operation of the pump or vacuum container in the system on the discharge system of the device, causes the liquid, possibly containing solids or semi-solid materials, to flow through line section 12 into housing 80. With the blade being driven by motor 94, the pulverizable materials are readily reduced to a size which permits the particles to pass through the openings to screen 86. However, the materials which cannot be pulverized by blade 92 are initially revolved across the surface of the plate, and, when these materials reach the imperforate portion 90, the suction from the pump or vacuum tank cannot hold the undisintegratable solid materials on the screen, and hence these materials will drop into sump 82, where they will accumulate until they are removed by either opening the door or by the use of a system or mechanism which cleans out the sump continuously or from time to time. The unpulverizable materials which, as mentioned, tend to adhere to the face of the screen are, by the construction illustrated in FIG. 6, pushed outwardly toward the periphery of the screen and carried by the blade to the imperforate area 90. When the unpulverizable solid materials reach the imperforate area, the suction holding the solid particles on the inlet or blade side of the screen is substantially eliminated, thereby permitting the solid undisintegratable materials to drop into the sump. Thus, the water or other liquid containing only relatively small particles of solid or semi-solid materials passes through the pulverizer device to the pump or vacuum container, and the larger particles, having been eliminated from the liquid being pumped, are collected in the sump for proper disposal apart from the liquid. The modified form of FIGS. 5 and 6 substantially increases the versatility and adaptability of the present device to various liquid handling systems, since it effectively provides a separation section for the undisintegratable materials which should not pass through the screen to the pump or vacuum tank. This modified form can be used, in addition to pumping the waste water, to handle fresh water containing small amounts of solid undisintegratable material which could enter the intake section 12 and the housing and might otherwise clog the pulverizing device of FIGS. 1 through 4 or require frequent cleaning of the device to maintain it in proper operating condition. The two embodiments of the present invention described herein eliminate or minimize the clean-out operations required to maintain the liquid handling system in effective operation.

The present pulverizer device of either embodiment will chop most of the materials found in the liquid, such as manure slurry, and separate screens in front of the pump or at the inlet to line 12 are no longer required. Blades 50 and 92 operating in front of screens 42 and 86 make the device self cleaning; thus, only when unpulverizable materials are encountered will the screen have to be manually cleaned, and cleaning the pulverizer device is faster and easier than cleaning the conventional screens used in manure pits or lagoons. Thus, a considerable saving in time is realized from use of the present pulverizer device, when, for example, a liquid manure holding system is emptied.

Although only two embodiments of a pulverizer for liquid handling systems have been shown and described in detail herein, various changes may be made without departing from the scope of the present invention.

I claim:

1. A pulverizer device for handling liquids containing solid and semi-solid materials, comprising a housing for receiving untreated liquid and for discharging treated liquid, an inlet port adapted for connection to a liquid supply means, a discharge port adapted for connection to a liquid collection or handling system, a screen in said housing disposed between said ports for trapping solids and semi-solids in the untreated liquid and having a substantially imperforate area near the bottom to facilitate removal of hard solids from said screen means on the intake side thereof, chopping means for pulverizing the solids and semi-solids in the liquid, a sump disposed in said housing beneath said screen for collecting the undisintegrated hard solids in the liquid, and a port means having a closure for removing the collected solids from said sump.

2. A pulverizer device as defined in claim 1 in which said chopping means includes a blade operating on the intake side of said screen in close proximity thereto.

3. A pulverizer device as defined in claim 2 in which a hydraulic motor operates said blade.

4. A pulverizer device as defined in claim 3 in which said motor is disposed on the discharge side of said screen, a drive shaft from said motor extends through said screen, and said blade is attached to said drive shaft on the intake side of said screen and revolves over the surface thereof.

5. A pulverizer device as defined in claim 4 in which said screen is disposed in said housing transverse to the flow of liquid therethrough, said shaft extends through said screen at the center thereof, and said blade is disposed parallel with the surface of said screen.

6. A pulverizer device as defined in claim 4 in which said sump is provided in said housing near the bottom thereof and at the lower edge of said screen, and said clean-out port means is disposed in said housing in the proximity of said sump.

7. A pulverizer device as defined in claim 2 in which said sump is provided in said housing near the bottom thereof and at the lower edge of said screen, and said clean-out port means having a closure is disposed in said housing near said screen.

8. A pulverizer device as defined in claim 1 in which said sump is provided in said housing near the bottom thereof and at the lower edge of said screen, and said clean-out port means having a closure is disposed in said housing near said screen.

9. A pulverizer device as defined in claim 1 in which said chopping means is a rotatable blade operating near said screen.

10. A pulverizer device as defined in claim 9 in which said blade is operated by a hydraulic motor.

11. A pulverizer device as defined in claim 9 in which said port means is disposed in said housing near said blade.

12. A pulverizer device as defined in claim 1 in which said screen is disposed in said housing transverse to the flow of liquid through said housing, a drive means is disposed on the discharge side of said screen and has a drive shaft extending perpendicularly through said screen at the center thereof, and a blade is attached to said shaft and rotates parallel with said screen on the intake side of said screen.

13. A pulverizer device as defined in claim 12 in which said drive means is a hydraulic motor, and pressure and return lines are disposed between said motor and hydraulic couplings on the outside of said housing.

14. A pulverizer device as defined in claim 8 in which a drive means is disposed on the discharge side of said screen and has a drive shaft extending perpendicularly through said screen at the center thereof, and a blade is attached to said shaft and rotates parallel with said screen on the intake side of said screen.

15. A pulverizer device as defined in claim 14 in which said area of said screen disposed near the bottom thereof extends upwardly from the margin of the screen.

* * * * *